US010119365B2

(12) United States Patent
Sanchez et al.

(10) Patent No.: US 10,119,365 B2
(45) Date of Patent: Nov. 6, 2018

(54) TUBULAR ACTUATION SYSTEM AND METHOD

(71) Applicants: James Scott Sanchez, Tomball, TX (US); Jason M. Harper, Cypress, TX (US); James G. King, Kingwood, TX (US)

(72) Inventors: James Scott Sanchez, Tomball, TX (US); Jason M. Harper, Cypress, TX (US); James G. King, Kingwood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 743 days.

(21) Appl. No.: 14/605,032

(22) Filed: Jan. 26, 2015

(65) Prior Publication Data

US 2016/0215589 A1 Jul. 28, 2016

(51) Int. Cl.
*E21B 34/14* (2006.01)
*E21B 34/00* (2006.01)

(52) U.S. Cl.
CPC ..... *E21B 34/14* (2013.01); *E21B 2034/007* (2013.01)

(58) Field of Classification Search
CPC combination set(s) only.
See application file for complete search history.

(56) References Cited

U.S. PATENT DOCUMENTS 3,054,415 A * 9/1962 Baker ..... E21B 34/14 137/625.38
3,065,796 A * 11/1962 Nutter ..... E21B 23/006 166/150
3,469,591 A 9/1969 Odendahl
3,980,135 A 9/1976 Garrett
4,026,363 A 5/1977 Yonker et al.
4,066,128 A 1/1978 Davis et al.
4,176,717 A * 12/1979 Hix ..... E21B 34/14 166/154
4,260,017 A * 4/1981 Nelson ..... E21B 33/16 166/154
4,357,952 A 11/1982 Knecht
(Continued)

FOREIGN PATENT DOCUMENTS

CA 2760107 A1 11/2010
CA 2770064 A1 2/2011
WO 1999005395 A1 2/1999

OTHER PUBLICATIONS

Baker Oil Tools, "Waterflood Regulators," Flow Control Catalog, Waterflood Regulators/Accessories, Jul. 2004, p. 78, Baker Oil Tools, United States.

(Continued)

*Primary Examiner* — Cathleen R Hutchins
*Assistant Examiner* — Ronald R Runyan
(74) *Attorney, Agent, or Firm* — Cantor Colburn LLP

(57) ABSTRACT

A tubular actuation system includes a housing and an activatable sleeve including a first assembly having a first radially movable seat, a second assembly having a second radially movable seat, and an insert disposed between the first and second assemblies. The activatable sleeve is movable longitudinally from a first position to a second position, and from a second position to a third position within the housing.

24 Claims, 5 Drawing Sheets

(56) References Cited

U.S. PATENT DOCUMENTS

| | | | | |
|---|---|---|---|---|
| 4,360,064 | A | 11/1982 | O'Connor, III et al. | |
| 4,441,558 | A | 4/1984 | Welch et al. | |
| 4,629,002 | A | 12/1986 | Pringle | |
| 4,790,378 | A | 12/1988 | Montgomery et al. | |
| 4,951,752 | A | 8/1990 | Coleman | |
| 4,962,815 | A | 10/1990 | Schultz et al. | |
| 4,976,314 | A | 12/1990 | Crawford et al. | |
| 5,018,575 | A | 5/1991 | Parsons | |
| 5,291,947 | A | 3/1994 | Stracke | |
| 5,297,634 | A | 3/1994 | Loughlin | |
| 5,743,497 | A | 4/1998 | Michael | |
| 5,803,119 | A | 9/1998 | Steinke | |
| 5,803,179 | A | 9/1998 | Echols et al. | |
| 5,896,928 | A | 4/1999 | Coon | |
| 5,975,205 | A * | 11/1999 | Carisella | E21B 43/045 166/134 |
| 6,112,817 | A | 9/2000 | Voll et al. | |
| 6,325,153 | B1 | 12/2001 | Harrell | |
| 6,334,486 | B1 | 1/2002 | Carmody et al. | |
| 6,382,569 | B1 | 5/2002 | Schattner et al. | |
| 6,619,392 | B2 | 9/2003 | Marangoni et al. | |
| 6,622,794 | B2 | 9/2003 | Zisk, Jr. | |
| 6,634,428 | B2 | 10/2003 | Krauss et al. | |
| 6,644,412 | B2 | 11/2003 | Bode et al. | |
| 6,648,076 | B2 | 11/2003 | Broome | |
| 6,810,955 | B2 | 11/2004 | Roth et al. | |
| 6,883,610 | B2 | 4/2005 | Depiak | |
| 6,883,613 | B2 | 4/2005 | Bode et al. | |
| 7,222,676 | B2 | 5/2007 | Patel et al. | |
| 7,255,178 | B2 | 8/2007 | Slup et al. | |
| 7,261,155 | B1 | 8/2007 | Ward et al. | |
| 7,918,275 | B2 | 4/2011 | Clem | |
| 7,984,760 | B2 | 7/2011 | Haeberle et al. | |
| 8,069,921 | B2 | 12/2011 | Garcia et al. | |
| 8,291,988 | B2 * | 10/2012 | King | E21B 23/04 166/153 |
| 8,646,531 | B2 | 2/2014 | King et al. | |
| 8,662,162 | B2 | 3/2014 | Kellner et al. | |
| 8,739,864 | B2 | 6/2014 | Crider et al. | |
| 8,770,299 | B2 | 7/2014 | King | |
| 2001/0040033 | A1 | 11/2001 | Schnatzmeyer et al. | |
| 2002/0020534 | A1 | 2/2002 | Wilson et al. | |
| 2007/0163774 | A1 | 7/2007 | Hosatte et al. | |
| 2007/0181312 | A1 | 8/2007 | Kritzler et al. | |
| 2008/0035350 | A1 | 2/2008 | Henriksen et al. | |
| 2008/0041581 | A1 | 2/2008 | Richards | |
| 2008/0047703 | A1 | 2/2008 | Stoesz et al. | |
| 2008/0093080 | A1 | 4/2008 | Palmer et al. | |
| 2008/0190608 | A1 | 8/2008 | Coronado et al. | |
| 2008/0283238 | A1 | 11/2008 | Richards et al. | |
| 2009/0008078 | A1 | 1/2009 | Patel | |
| 2009/0095468 | A1 | 4/2009 | Augustine et al. | |
| 2009/0120647 | A1 | 5/2009 | Turick et al. | |
| 2011/0000660 | A1 | 1/2011 | Joseph et al. | |
| 2011/0000679 | A1 | 1/2011 | Joseph et al. | |
| 2011/0278017 | A1 | 11/2011 | Themig et al. | |
| 2012/0305265 | A1 * | 12/2012 | Garcia | E21B 34/063 166/373 |

OTHER PUBLICATIONS

Blount, C.G., et al., "Inflatable CT Conveyed Selective Well Testing System for Logging Openhole and Horizontal Wellbored: Development and Use," Article, SPE/IcoTA Coiled Tubing Conference and Exhibition, Apr. 8-9, 2003, 11 Pages, SPE No. 81718-MS, Texas, United States.

Brian Champion, "A New Wireless Solution to Real Time Reservoir Surveillance and In-flow Control-Applications of Interest for Underground Gas Storage," For presentation at the 9th Annual Global Gas Village Summit (Europe), 24 Pages, Apr. 14-16, 2009, Milan, Italy.

Cyvas, M.K., "Subsea Adjustable Choke Valves: A Focus on a Critical Component," Article, SPE Production Engineering, Aug. 1989, pp. 301-208., vol. 4, No. 3, SPE Paper No. 16609-PA, United States.

Gai, H., "Requirements of Downhole Flow Control Valve," Article, SPE Annual Technical Conference and Exhibition, Oct. 5-8, 2003, 7 Pages, SPE Paper No. 84323-MS, Denver, Colorado, United States.

Kelkouli, Redha, et al., "Case Study in Water Shutoff Fluid Placement Using Straddled Through-Tubing Inflatable-Packers Technique," Article, SPE Middle East Oil and Gas Show and Conference, Mar. 11-14, 2008, 13 Pages, SPE Paper No. 104755-MS, Kingdom of Bahrain.

Winkler,H.W., et al., "Dynamic Performance Testing of Single-Element Unbalances Gas-Life Valves," Article; SPE Production Engineering, Aug. 1987, pp. 183-190., vol. 2, No. 3, SPE Paper No. 14348-PA, United States.

"Packers Plus Unlocks its Newest Technology in RepeaterPORT;" Article; Packers Plus; Aug. 10, 2011; http://packersplus.com/packers-plus-unlocks-its-newest-technology-in-repeaterport/; 3 pages.

"ZoneSelect® i-ball® Multizone Stimulation Sleeves, Isolate and Fracture More Than 45 Lower Horizontal Openhole Sections in Bakken Shale;";Weatherford, 2012-2014, 2 pages.

* cited by examiner

TUBULAR ACTUATION SYSTEM AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

Tubular system operators employ methods and devices to permit actuation of tubular tools for use within the boreholes. Temporary or permanent plugging device against which to build pressure to cause an actuation are commonly employed. Sometimes actuating is desirable at a first location, and subsequently at a second location. Moreover, additional actuating locations may also be desired and the actuation can be sequential for the locations or otherwise. Systems employing droppable members, such as balls, for example, are typically used for just such purpose. The ball is dropped to a ball seat positioned at the desired location within the borehole thereby creating the desired plug to facilitate the actuation. When running a tubular actuation apparatus in unconventional reservoirs, a single entry sleeve utilizes one activation device (such as a ball) to open the sleeve so that the zone can be stimulated. For example, a ball can be dropped from surface, land on a landing seat within the sleeve, and pressure applied uphole of the ball will move the sleeve in a downhole direction revealing ports in an outer housing of the apparatus.

In applications where the first location is further from surface than the second location, it is common to employ seats with sequentially smaller diameters at locations further from the surface. Dropping balls having sequentially larger diameters allows the ball seat furthest from surface to be plugged first (by a ball whose diameter is complementary to that seat), followed by the ball seat second furthest from surface (by a ball whose diameter is complementary to that seat) and so on. The foregoing system, however, creates increasingly restrictive dimensions within the borehole that may negatively impact flow therethrough as well as limit the size of tools that can be run into the borehole.

The art would be receptive to improved devices and methods for allowing operators to increase the number of actuable locations within a borehole without unduly restricting the inner diameter of the tool over the length of a string.

BRIEF DESCRIPTION

A tubular actuation system includes a housing and an activatable sleeve including a first assembly having a first radially movable seat, a second assembly having a second radially movable seat, and an insert disposed between the first and second assemblies. The activatable sleeve is movable longitudinally from a first position to a second position, and from a second position to a third position within the housing.

A downhole system includes a string disposable within a borehole, at least one tubular actuation system connected to the string, and first and second activation devices having a substantially same size. A first tubular actuation system amongst the at least one tubular actuation system is operable from the first position to the second position through deployment of the first activation device, and from the second position to the third position through deployment of the second activation device.

A method of actuating a tubular actuation system includes dropping a first activation device into a sleeve in a first position within a housing of the tubular actuation system, the first activation device passing through a first radially movable seat of the sleeve expanded into the housing and landing the first activation device on a second radially movable seat of the sleeve restricted within the housing; increasing pressure within the tubular actuation system uphole of the first activation device landed on the second radially movable seat; moving the sleeve in a downhole direction with respect to the housing to a second position to restrict the first radially movable seat within the housing, and to expand the second radially movable seat into the housing to release the first activation device; dropping a second activation device into the sleeve and landing the second activation device on the first radially movable seat restricted within the housing; increasing pressure within the tubular actuation system uphole of the second activation device landed on the first radially movable seat; and, moving the sleeve in a downhole direction with respect to the housing to a third position.

A method of treating a wellbore includes dropping a first activation device into a first tubular actuating system, the first tubular actuating system including a ported housing and a longitudinally movable activatable sleeve including a first radially movable seat, a second radially movable seat, and an insert disposed between the first and second seats; landing the first activation device on the second seat, downhole of the first seat; increasing pressure within the first tubular actuation system uphole of the first activation device to move the sleeve in a downhole direction and release the first activation device from the second seat; dropping a second activation device, having a substantially same size as the first activation device, into the first tubular actuation system, the second activation device landing on the first seat; increasing pressure within the first tubular actuation system uphole of the second activation device landed on the first seat to move the sleeve in a downhole direction and expose at least one port in the housing; and, treating the wellbore through the at least one port of the first tubular actuation system.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
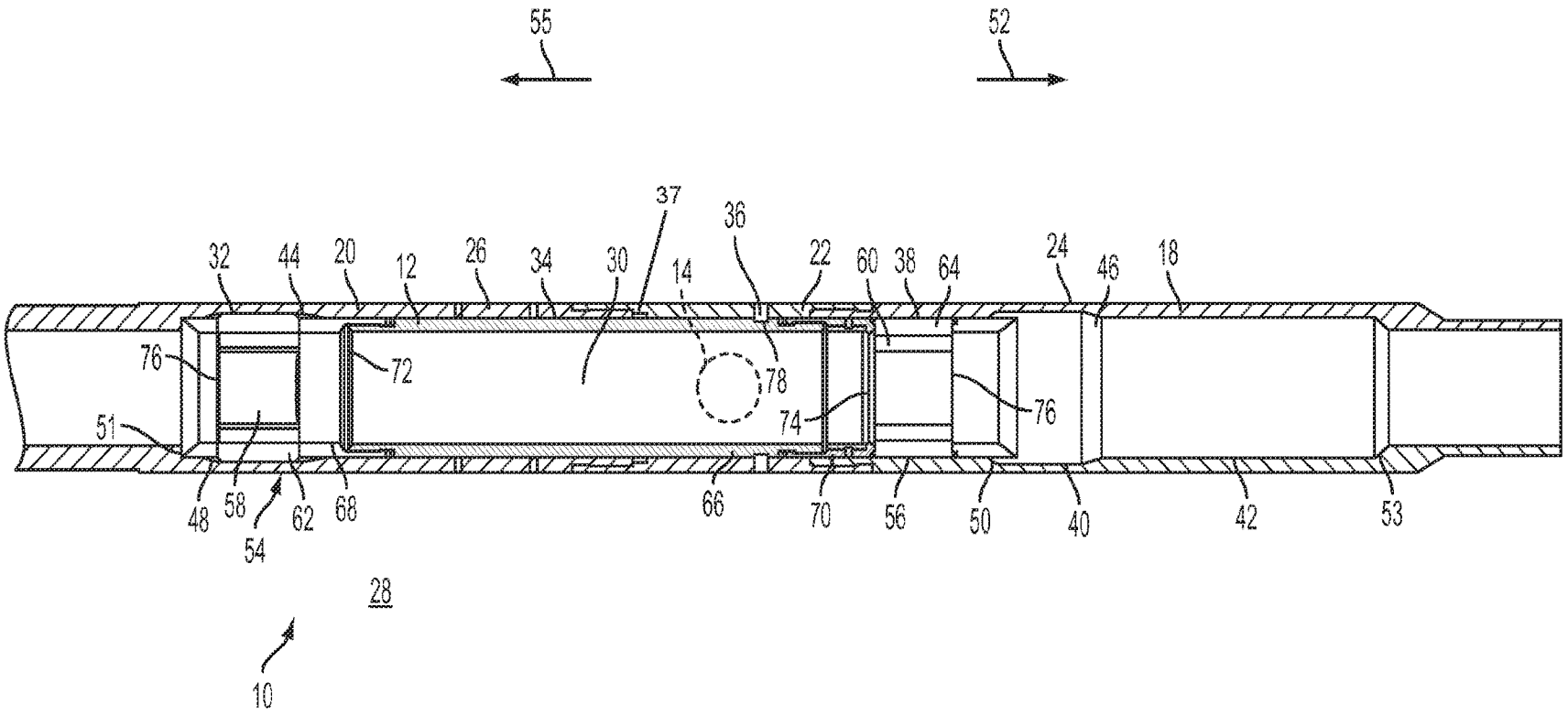
FIG. 1 depicts a sectional view of an embodiment of a tubular actuation system in a run-in and closed condition.
Figure 2:
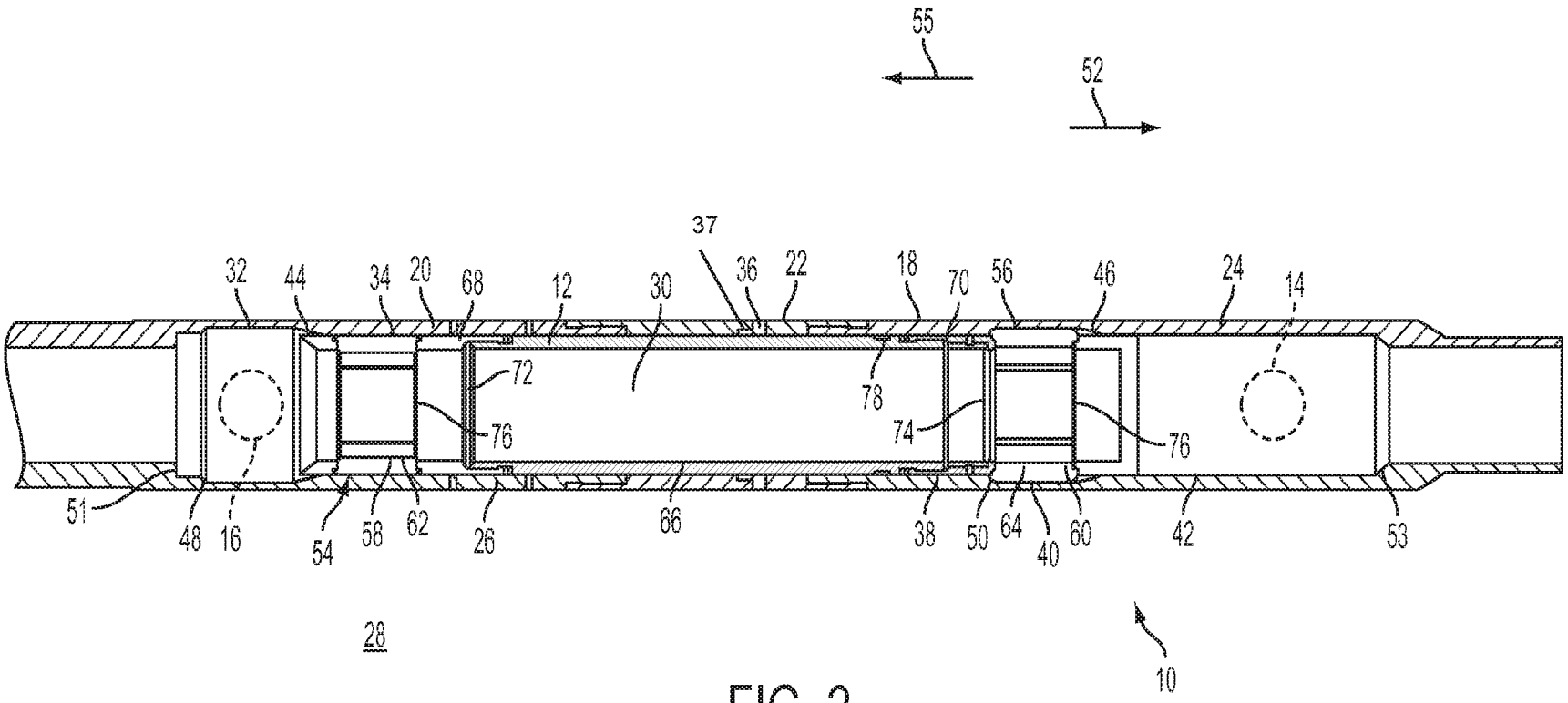
FIG. 2 depicts a sectional view of the tubular actuation system of FIG. 1 in an intermediate and closed condition.
Figure 3:
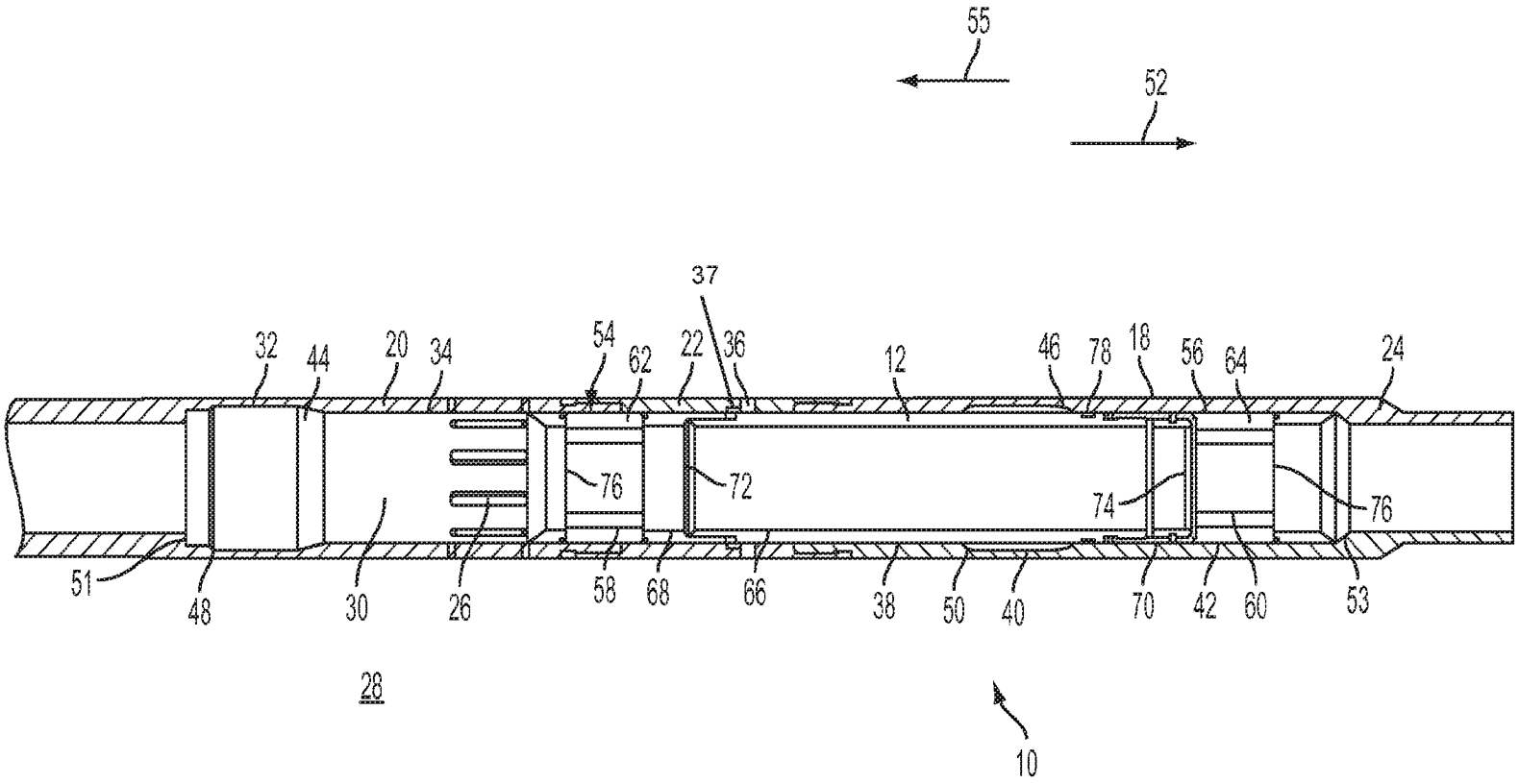
FIG. 3 depicts a sectional view of the tubular actuation system of FIG. 1 in an open condition.

Referring now to FIGS. 1-3 an embodiment of a tubular actuating system 10 is shown that uses multiple activation devices, and more particularly occluding devices (such as balls) 14, 16, prior to opening to the reservoir. In one embodiment, the tubular actuation system 10 includes an activatable sleeve 12, such as a ball activated frac sleeve, however activation devices other than balls may be employed. An operation of the tubular actuation system 10 uses multiple activation devices 14, 16 that may be dropped, and has multiple positions.

The illustrated tubular actuation system 10 includes a housing 18 having a first sub 20, intermediate sub 22, and second sub 24. When combined as a housing 18 and connected to a string 102 (FIG. 4) and run downhole, the first sub 20 would be located uphole of the intermediate sub 22 and second sub 24. The first sub 20 includes at least one port 26, and more typically a plurality of ports 26 radially distributed about a circumference of the housing 18. The ports 26 provide fluidic communication between the exterior 28 of the tubular actuation system 10, which may face an annulus 116 (FIG. 4) between the string 102 and a borehole wall 112, and the interior 30 of the tubular actuation system 10, unless the ports 26 are blocked as in FIGS. 1 and 2. The first sub 20 includes a first enlarged seat receiving section 32 and a first restricted seat receiving section 34. The ports 26 may be disposed in the first restricted seat receiving section 34. The intermediate sub 22 includes at least a first shear apparatus 36, such as a shear pin, extending at least partially into the interior 30 of the housing 18. The second sub 24 includes a second restricted seat receiving section 38, a second enlarged seat receiving section 40, and a third restricted seat receiving section 42, with the second enlarged seat receiving section 40 disposed between the second and third restricted seat receiving sections 38, 42. The first and second enlarged seat receiving sections 32, 40 in the first and second subs 20, 24 include tapered camming surfaces 44, 46 at downhole ends thereof that smooth the transition between the first enlarged seat receiving section 32 and the first restricted seat receiving section 34, and between the second enlarged seat receiving section 40 and the third restricted seat receiving section 42, respectively. The first and second enlarged seat receiving sections 32, 40 in the first and second subs 20, 24 may further include shoulders 48, 50 at uphole ends thereof. Additionally, the housing 18 may further include inner stop shoulders 51, 53 to prevent travel of the sleeve 12 outside of the housing 18. In one embodiment, an inner diameter of the first, second, and third restricted seat receiving sections 34, 38, 42 are substantially the same. However, in an alternate embodiment, these may be different as will be further described below.

Disposed within the housing 18 is the activatable sleeve 12, such as a ball activated sleeve, that is longitudinally movable with respect to the housing 18 in at least the downhole direction 52 (opposite an uphole direction 55). The activatable sleeve 12 includes at least first and second seat assemblies 54, 56 that include first and second radially movable (expandable and restrictable) seats 58, 60. The seats 58, 60 may include first and second sets of segmented dogs 62, 64, as illustrated. Alternatively, the seats 58, 60 may include a c-ring, snap ring, collet or other biasing device that biases the seats 58, 60 radially outwardly when the seats 58, 60 are located in an enlarged seat receiving section 32, 40, but allows the seats 58, 60 to retract into the restricted seat receiving sections 34, 38, 42 when the seats 58, 60 are located therein. The first and second seat assemblies 54, 56 are separated by an insert 66 that isolates the internal components of the tubular actuation system 10 such as by seals that straddle the ports 26 in the housing 18 until the sleeve 12 is shifted into the final position and the zone is ready for stimulation, as shown in FIG. 3. The first and second seat assemblies 54, 56 may include first and second seat supports 68, 70 that are connected to the uphole and downhole ends 72, 74 of the insert 66. In the embodiment where the seats 58, 60 include segmented dogs 62, 64, the seat supports 68, 70 include windows 76 that are circumferentially spaced about the seat supports 68, 70. The segmented dogs 62, 64 at least partially extend respectively radially outwardly through the windows 76 of the seat supports 68, 70 when the seat assemblies 54, 56 are longitudinally located so that the segmented dogs 62, 64 are positioned within the first and second enlarged seat receiving section 32, 40, and the segmented dogs 62, 64 are at least partially retracted within the windows 76 of the seat supports 68, 70 when the first and second seat assemblies 54, 56 are longitudinally located so that the segmented dogs 62, 64 are positioned within the first, second, or third restricted seat receiving sections 34, 38, 42. In one embodiment, the first radially movable seat 58 has a first diameter in the first position of the activatable sleeve 12 and a second diameter in the second and third positions of the activatable sleeve 12, while the second radially movable seat 60 has the first diameter in the second position of the activatable sleeve 12 and the second diameter in the first and third positions of the activatable sleeve 12.

FIG. 1 shows a run-in condition of the tubular actuation system 10, and an initial position where the activatable sleeve 12 is positioned in an uphole location within the housing 18, adjacent stop shoulder 51, such that the first set of segmented dogs 62 are disposed within the first enlarged seat receiving section 32 of the first sub 20, and the second set of segmented dogs 64 are disposed within the second restricted seat receiving section 38 of the second sub 24. Once a first device 14 is dropped from surface, the first device 14 will pass through the first seat assembly 54 in the first sub 20 and land within the second seat assembly 56 in the second sub 24. With the longitudinal flow path through the interior 30 of the tubular actuation system 10 blocked by the first activation device 14, pressure can be built up uphole of the first activation device 14, forcing the activatable sleeve 12 in the downhole direction 52, shearing the first shear apparatus 36 via a notch 78 in the insert 66, and camming the first set of segmented dogs 62 out of the first enlarged seat receiving section 32 and into the first restricted seat receiving section 34. The insert 66 connects the first and second radially movable seats 58, 60 such that longitudinal movement of the second radially movable seat correspondingly results in longitudinal movement of the insert 66 and the first radially movable seat 58. The activatable sleeve 12 will move longitudinally in the downhole direction 52 until the second set of segmented dogs 64 land and expand into the second enlarged seat receiving section 40, as shown in FIG. 2. When the second set of segmented dogs 64 land and expand into the second enlarged seat receiving section 40, the first activation device 14 is released from the tubular actuation system 10 for use by a tubular actuation system located further downhole. The first set of segmented dogs 62 located within the first restricted seat receiving section 34 are ready to receive and seat a second activation device 16 that is dropped from surface 118 (FIG. 6) or other uphole location. A second shear apparatus 37 may be operatively disposed between the housing 18 and the insert 66 to prevent premature movement of the activatable sleeve 12 from the second position to the third position. The second shear apparatus 37 is longitudinally movable with the insert 66 from the first position (FIG. 1) to the second position (FIG. 2), and blocked from longitudinal movement with the insert 66 from the second position (FIG. 2) to the third position (FIG. 3) by the first shear apparatus 36. Upon receipt of the second activation device 16 within the first seat assembly 54, increased pressure uphole of the first seat assembly 54 can force the activatable sleeve 12 further in a downhole direction so to expose the ports 26 in the housing 18, as shown in FIG. 3. At this point, the zone within which the tubular actuation system 10 is situated can be stimulated with fracturing fluids moving in the downhole direction 52 and subsequently through the ports 26. The fracturing fluids are prevented from further travel downhole due to the occluded interior 30 as a result of the second activation device 16 situated within the first ball seat assembly 54. After all zones have been stimulated, typically from a downhole-most zone to an uphole-most zone, the segmented dogs 62, 64, which are positioned radially inwardly within the housing 18, may be milled out for clearing the interior 30 and providing a flowpath therethrough.

Figure 4:
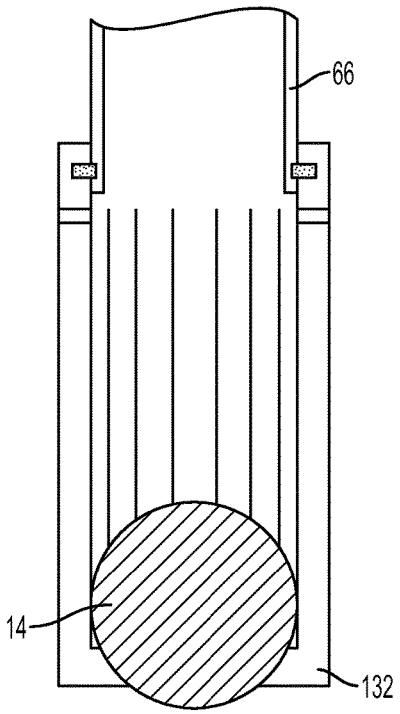
FIG. 4 depicts a sectional view of a collet arrangement in a radially restricted condition for the tubular actuation system.
Figure 5:
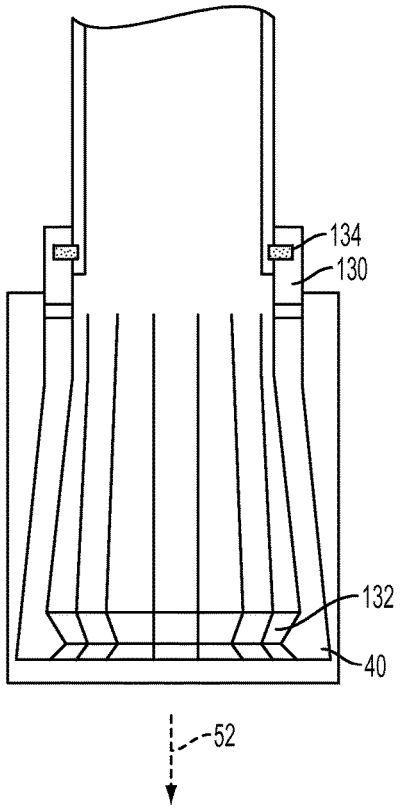
FIG. 5 depicts a sectional view of a collet arrangement in a radially expanded condition for the tubular actuation system; and, FIG. 6 depicts an embodiment of a downhole system including the tubular actuation system.

While one embodiment has been described for the tubular actuation system 10, alternate arrangements may be provided. For example, the radially movable seats 58, 60 need not include the segmented dogs 62, 64 as illustrated, but may instead include alternate constructions for radially movable seats. In one alternative embodiment, the lower mechanism that can activate the sleeve 12 into the second position shown in FIG. 2 can be pins and collet arrangement, as shown in FIGS. 4 and 5, with the collet 130 serving as the radially movable seat 60. Fingers 132 of the collet 130 may be in a radially compressed condition as shown in FIG. 4 when disposed within the second restricted seat receiving section 38 for receipt of first activation device 14, and then be allowed to expand, as shown in FIG. 5, to their biased condition within the second enlarged seat receiving section 40 to release the first activation device 14. The collet 130 may be shear pinned to the insert 66 at pins 134 such that upon receipt of second activation device 16 within the first radially movable seat 58 (FIGS. 1-3), the second activation device 16, seat 58, and insert 66 can continue in the downhole direction 52 upon uphole pressure acting on the device 16 to open the port 26. Similarly, the first radially movable seat 58 may include the collet 130 with the fingers 132 pointing in the uphole direction 55. In such an embodiment, the fingers 132 would be expanded in the first enlarged seat receiving section 32 for passing the first activation device 14 thereby. After the sleeve 66 drags the collet 130 into the first restricted seat receiving section 34, the fingers 132 would then be radially compressed to receive the second activation device 16 thereon. Alternatively, both the first and second radially movable seats 58, 60 could include the collet 130 in lieu of the segmented dogs 62, 64.

In order to utilize the same size activation device 14, 16, the seats 58, 60 must include a substantially same sized effective inner diameter while within the respective restriction sections 34, 38 so that they can block the activation devices 14, 16 from movement therepast. However, this may alternatively be accomplished by altering both the sizes of the seats 58, 60 and restricted seat receiving sections 34, 38 to provide the substantially same size effective inner diameter. Alternatively, the tubular actuating system 10 could be modified to provide the ability to be activated by different size activation devices 14, 16 if needed for a particular operation, such as by providing different inner diameters of the enlarged seat receiving sections 32, 40, and different inner diameters of the restricted seat receiving sections 34, 38, 42, or by providing the radially movable seats 58, 60 with different sized segmented dogs 62, 64 such that the inner diameters thereof are adjusted as needed.

Figure 6:
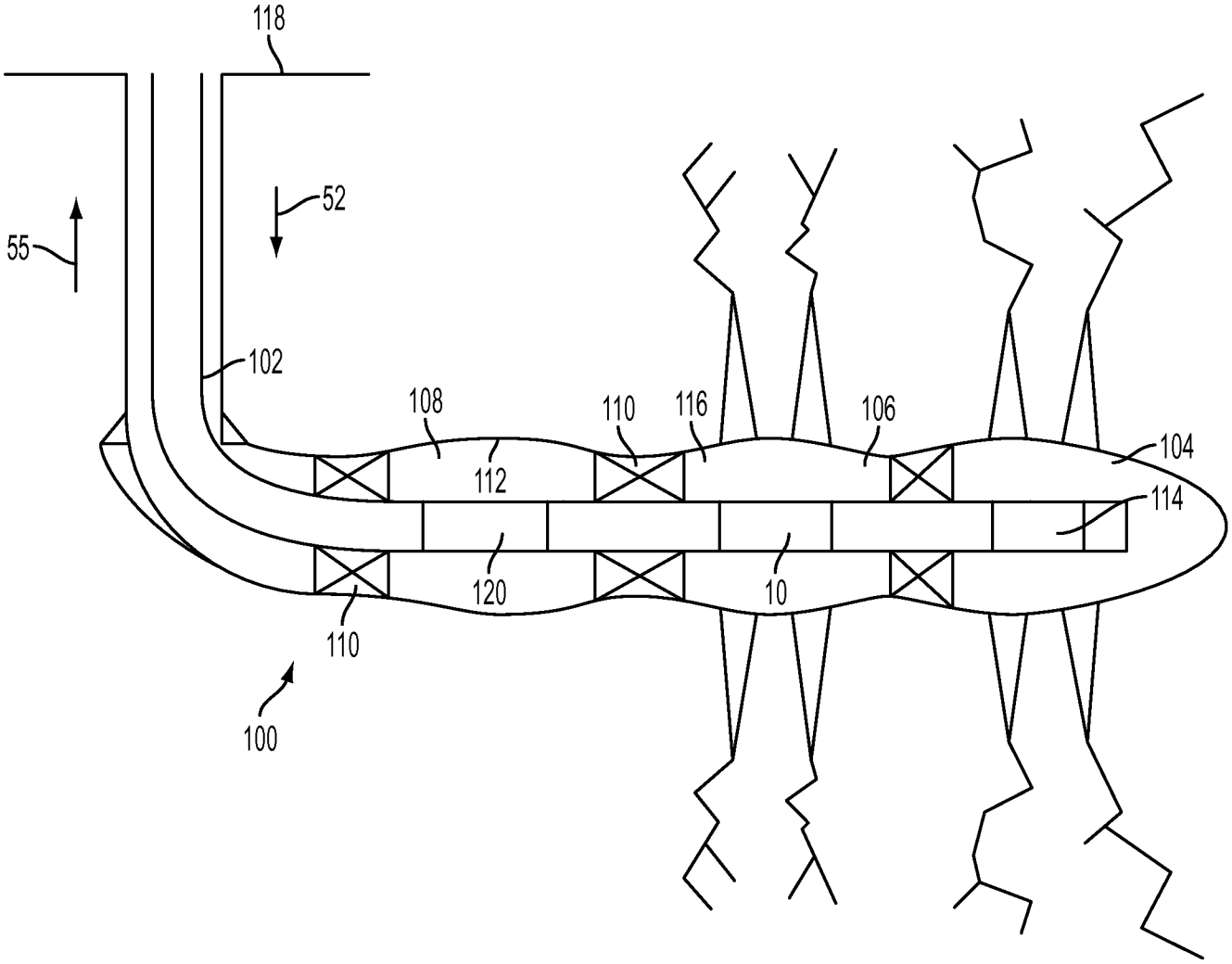

While only one tubular actuating system 10 is depicted in FIGS. 1-3, multiple tubular actuating systems 10 can be interconnected in a downhole system 100 along a pipe string 102, such as shown in FIG. 6, with one or more tubular actuating systems 10 located within each respective zone 104, 106, 108 to be treated. Each zone 104, 106, 108 may be segregated from adjacent zones 104, 106, 108 and defined by isolation packers 110 or the like. When the activation sleeve 12 is moved from the port 26 in each tubular actuating system 10 to fluidically connect the port 26 with an interior 30 of tubular actuating system 10 and the pipe string 102, frac fluids may be forced through the ports 26 and substantially maintained within the zone 106 by the isolation packers 110.

With reference to FIG. 6, assuming the tubular actuation system 10 is a second tubular actuation system 10, and the string 102 within the borehole 112 includes at least a first tubular actuation system 114 located downhole of the second tubular actuation system 10, then a first position of the second tubular actuation system 10 allows a first activation device 14 to pass through the second tubular actuation system 10 to the first tubular actuation system 114 located downhole from the second tubular actuation system 10 and allows for stimulation at a stage/zone downhole of the second tubular actuation system 10, such as zone 104. The activatable sleeve 12 within the second tubular actuation system 10 has been moved by the first activation device 14 into an intermediate second position but does not open the second tubular actuation system 10 to the annulus 116 between the borehole 112 and the pipe string 102. A second activation device 16 is then dropped from surface 118, or other location uphole of the second tubular actuation system 10, and pressure is applied to shift the activatable sleeve 12 into a third position, corresponding to an open condition of the second tubular actuation system 10, which allows for subsequent stimulation of zone 106. Thus, both the first and second tubular actuation systems 10, 114 can be operated using a same size activation device. Other tubular actuation systems, such as tubular actuation system 120, located uphole of the second tubular actuation system 10, may be actuated using activation devices (balls) having larger diameters such that the tubular actuation system 120 is not activated when the first and second activation devices 14, 16 are delivered therethrough.

While fracturing operations, stimulation, and treatment of the well has been described through the opening of port 26, the teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A tubular actuation system comprising:

a housing having a radial port; and an activatable sleeve including:

a first assembly having a first radially movable seat;

a second assembly having a second radially movable seat; and an insert disposed between the first and second assemblies;

wherein the activatable sleeve is movable longitudinally from a first position with the first radially movable seat expanded into the housing and the second radially movable seat retracted within the housing to form a seat to a second position with the second radially movable seat expanded into the housing, and from the second position to a third position within the housing exposing the radial port, the first radially movable seat and the second radially movable seat are both retracted within the housing in the third positon, the insert isolating an interior of the tubular actuation system from the radial port until the sleeve is moved to the third position.

2. The tubular actuation system of claim 1, wherein at least two activation devices are required to move the activatable sleeve from the first position to the third position.

3. The tubular actuation system of claim 1, wherein the housing includes a first enlarged seat receiving section and a first restricted seat receiving section having an inner diameter smaller than an inner diameter of the first enlarged seat receiving section, and the first radially movable seat is movable from the first enlarged seat receiving section to the first restricted seat receiving section when the activatable sleeve is moved longitudinally.

4. The tubular actuation system of claim 1, wherein the first radially movable seat has a first inner diameter in the first position of the sleeve, a second inner diameter in the second position of the sleeve, the second inner diameter smaller than the first inner diameter.

5. The tubular actuation system of claim 4, wherein the second radially movable seat has an inner diameter in the first position of the sleeve that is smaller than an inner diameter in the second position of the sleeve.

6. The tubular actuation system of claim 1, wherein, in the first position of the sleeve, the first radially movable seat is expanded within the housing to allow a first activation device having a first outer diameter to pass thereby, and the second radially movable seat is radially compressed within the housing to seat the first activation device thereon.

7. The tubular actuation system of claim 6, wherein, in the second position of the sleeve, the first radially movable seat is radially compressed within the housing, and the second radially movable seat is expanded within the housing to allow the first activation device to pass thereby.

8. The tubular actuation system of claim 7, wherein, in the second position of the sleeve, the first radially movable seat is restricted within the housing to receive a second activation device thereon.

9. The tubular actuation system of claim 1, wherein the first and second radially movable seats each include a seat support having a plurality of circumferential windows and a plurality of segmented dogs configured to retract within the windows when in a restricted section of the housing and at least partially extend through the windows when in an enlarged section of the housing.

10. The tubular actuation system of claim 1, wherein at least one of the first and second radially movable seats includes a collet with radially expandable and compressible fingers.

11. The tubular actuation system of claim 1, wherein a first shear apparatus is operatively disposed between the housing and the insert to prevent premature movement of the activatable sleeve from the first position to the second position.

12. The tubular actuation system of claim 11, further comprising a second shear apparatus operatively disposed between the housing and the insert to prevent premature movement of the activatable sleeve from the second position to the third position.

13. The tubular actuation system of claim 12, wherein the second shear apparatus is longitudinally movable with the insert from the first position to the second position, and blocked from longitudinal movement with the insert from the second position to the third position.

14. The tubular actuation system of claim 1, wherein the first and second radially movable seats are alternately movable from a radially expanded position to a radially restricted position within the housing depending upon a longitudinal location of the sleeve with respect to the housing.

15. The tubular actuation system of claim 1, wherein the first and second assemblies and the insert are longitudinally movable together in a downhole direction upon receipt of an activation device within either of the first seat or second seat and pressure build-up uphole of the activation device.

16. The tubular actuation system of claim 1, wherein the first position of the sleeve corresponds to a closed condition of the tubular actuation system where the port is blocked by a first portion of the sleeve, the port is blocked by a second portion of the sleeve in the second position, and the third position of the sleeve corresponds to an open condition of the tubular actuation system where the port is not blocked by the sleeve.

17. A downhole system comprising:

a string disposable within a borehole;

at least one tubular actuation system of claim 1 connected to the string; and, first and second activation devices;

wherein a first tubular actuation system amongst the at least one tubular actuation system is operable from the first position to the second position through deployment of the first activation device, and from the second position to the third position through deployment of the second activation device.

18. A method of actuating the tubular actuation system of claim 1, the method comprising:

dropping a first activation device into the sleeve in the first position within the housing of the tubular actuation system, the first activation device passing through the first radially movable seat of the sleeve expanded into the housing and landing the first activation device on the second radially movable seat of the sleeve restricted within the housing;

increasing pressure within the tubular actuation system uphole of the first activation device landed on the second radially movable seat;

moving the sleeve in a downhole direction with respect to the housing to the second position to restrict the first radially movable seat within the housing, and to expand the second radially movable seat into the housing to release the first activation device;

dropping a second activation device into the sleeve and landing the second activation device on the first radially movable seat restricted within the housing;

increasing pressure within the tubular actuation system uphole of the second activation device landed on the first radially movable seat; and, moving the sleeve in a downhole direction with respect to the housing to the third position.

19. The method of claim 18, wherein the sleeve blocks the port in the first and second positions, and moving the sleeve to the third position includes moving the sleeve to unblock the port.

20. The method of claim 18, further comprising engaging a first shear apparatus prior to moving the sleeve in a downhole direction from the first position to the second position.

21. The method of claim 20, further comprising engaging a second shear apparatus prior to moving the sleeve in a downhole direction from the second position to the third position.

22. A method of treating a wellbore comprising:

dropping a first activation device into the tubular actuating system according to claim 1, landing the first activation device on the second seat, downhole of the first seat;

increasing pressure within the tubular actuation system uphole of the first activation device to move the sleeve in a downhole direction and release the first activation device from the second seat;

dropping a second activation device into the tubular actuation system, the second activation device landing on the first seat;

increasing pressure within the tubular actuation system uphole of the second activation device landed on the first seat to move the sleeve in a downhole direction and expose the port in the housing; and, treating the wellbore through the port of the tubular actuation system.

23. The method of claim 22, wherein treating the wellbore includes one or more of hydraulic fracturing, stimulation, tracer injection, cleaning, acidizing, steam injection, water flooding, and cementing.

24. The method of claim 22 wherein the tubular actuation system is a first tubular actuation system and further comprising, prior to dropping the second activation device, treating the wellbore through a second tubular actuation system, downhole of the first tubular actuation system, the second tubular actuation system in receipt of the first activation device after releasing the first activation device from the second seat.

* * * * *